US010437190B2

(12) United States Patent
Fujihara

(10) Patent No.: US 10,437,190 B2
(45) Date of Patent: Oct. 8, 2019

(54) IMAGE FORMING APPARATUS

(71) Applicant: KYOCERA Document Solutions Inc., Osaka-shi, Osaka (JP)

(72) Inventor: Kensuke Fujihara, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/986,611

(22) Filed: May 22, 2018

(65) Prior Publication Data

US 2018/0341205 A1 Nov. 29, 2018

(30) Foreign Application Priority Data

May 25, 2017 (JP) ..... 2017-103370

(51) Int. Cl.

*G03G 15/00* (2006.01)
*G03G 15/08* (2006.01)
*G03G 15/06* (2006.01)

(52) U.S. Cl.

CPC ..... *G03G 15/5004* (2013.01); *G03G 15/065* (2013.01); *G03G 15/08* (2013.01); *G03G 15/55* (2013.01)

(58) Field of Classification Search

CPC .. G03G 15/065; G03G 15/0907; G03G 15/08; G03G 15/5004; G03G 15/55; G03G 2221/1633

See application file for complete search history.

(56) References Cited

U.S. PATENT DOCUMENTS

2015/0261124 A1* 9/2015 Ikazaki ..... G03G 15/065 399/55

FOREIGN PATENT DOCUMENTS

JP 2004093701 A 3/2004

* cited by examiner

*Primary Examiner* — Ryan D Walsh

(74) *Attorney, Agent, or Firm* — Alleman Hall Creasman & Tuttle LLP

(57) ABSTRACT

An AC measuring circuit measures a magnitude of an alternating current flowing through a bias applying circuit synchronized with a cycle of an AC voltage in a developing bias voltage. A control unit changes a level of the AC voltage in the developing bias voltage, and executes a developing bias adjustment process for setting a level of the AC voltage based on the level of the AC voltage when the leakage current detecting circuit detects the direct current. The control unit, when a measurement by the AC measuring circuit during execution of a developing process exceeds a predetermined allowable value, executes a warning process to prompt execution of the developing bias adjustment process, or the control unit executes the developing bias adjustment process to update the level of the AC voltage.

4 Claims, 6 Drawing Sheets

IMAGE FORMING APPARATUS

INCORPORATION BY REFERENCE

This application is based upon and claims the benefit of priority from the corresponding Japanese Patent Application No. 2017-103370 filed on May 25, 2017, the entire contents of which are incorporated herein by reference.

BACKGROUND

The present disclosure relates to an image forming apparatus including a function for detecting aerial discharge between a photoconductor and a developing body.

In general, an electrophotographic image forming apparatus includes a developing device that includes a developing body for carrying toner, and a bias applying circuit. The bias applying circuit applies, between a photoconductor and the developing body, a developing bias voltage in which an AC voltage and a DC voltage are superimposed. The developing device executes a developing process for developing an electrostatic latent image on the photoconductor by using the toner carried by the developing body.

When the image forming apparatus is used in a low atmospheric pressure environment such as a high-altitude region, aerial discharge tends to occur between the photoconductor and the developing body. When the aerial discharge occurs, surface potential of the photoconductor is disturbed and image quality deteriorates. Generally, the aerial discharge is referred to as leakage.

The image forming apparatus includes a function for executing a developing bias adjustment process to prevent the aerial discharge from occurring. The developing bias adjustment process is executed to gradually increase the AC voltage in the developing bias voltage until the aerial discharge occurs, and then, based on the level of the AC voltage when the aerial discharge occurs, the developing bias adjustment process sets the level of the AC voltage in the developing bias voltage during execution of the developing process.

It is possible to detect occurrence of the aerial discharge by detecting a direct current flowing through the bias applying circuit, the circuit for applying the developing bias voltage between the photoconductor and the developing body.

The image forming apparatus, before being shipped, is installed in a standard environment in which conditions such as atmospheric pressure, temperature, and humidity are at predetermined standard states. The image forming apparatus executes the developing bias adjustment process in the standard environment. This allows for the level of the AC voltage in the developing bias voltage during execution of the developing process to be set at a standard level suitable for the standard environment.

Furthermore, in a state where the image forming apparatus is installed in its place of use, a serviceperson or a user executes a predetermined adjustment start operation on the image forming apparatus. The image forming apparatus executes the developing bias adjustment process in response to the adjustment start operation.

By executing the developing bias adjustment process in a state where the image forming apparatus is installed in its place of use, the level of the AC voltage in the developing bias voltage during execution of the developing process is updated from the standard level to a level suitable for the usage environment.

SUMMARY

An image forming apparatus according to an aspect of the present disclosure includes a photoconductor, a developing device, a bias applying circuit, a leakage current detecting circuit, an AC measuring circuit, and a control device. The photoconductor is a member on whose surface an electrostatic latent image is formed. The developing device includes a developing body and a bias applying circuit, wherein the developing body is disposed across a gap from the photoconductor and rotates while carrying toner, and the bias applying circuit applies, between the photoconductor and the developing body, a developing bias voltage in which an AC voltage and a DC voltage are superimposed. The developing device is configured to execute a developing process that develops the electrostatic latent image on the photoconductor using the toner on the developing body. The leakage current detecting circuit is configured to detect a direct current that flows through the bias applying circuit when aerial discharge occurs between the developing body and the photoconductor. The AC measuring circuit is configured to measure a magnitude of an alternating current that flows through the bias applying circuit in synchronization with a cycle of the AC voltage in the developing bias voltage. The control device is configured to execute a developing bias adjustment process for controlling the bias applying circuit to change a level of the AC voltage in the developing bias voltage. Then, based on a level of the AC voltage when the leakage current detecting circuit detects the direct current, the developing bias process executed by the control device sets a developing bias AC level, a level of the AC voltage in the developing bias voltage during execution of the developing process. When a measurement by the AC measuring circuit during the execution of the developing process exceeds a predetermined allowable value, the control device executes a warning process to prompt execution of the developing bias adjustment process, or the control device executes the developing bias adjustment process to update the level of the AC voltage in the developing bias voltage during execution of the developing process.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

First Embodiment

An image forming apparatus 10 according to a first embodiment includes a print processing device 4 for executing print processing electrographically. The print processing forms an image of a toner 90 on a sheet 9. The sheet 9 is a sheet-like image forming medium such as a sheet of paper or resin film.

Figure 1:
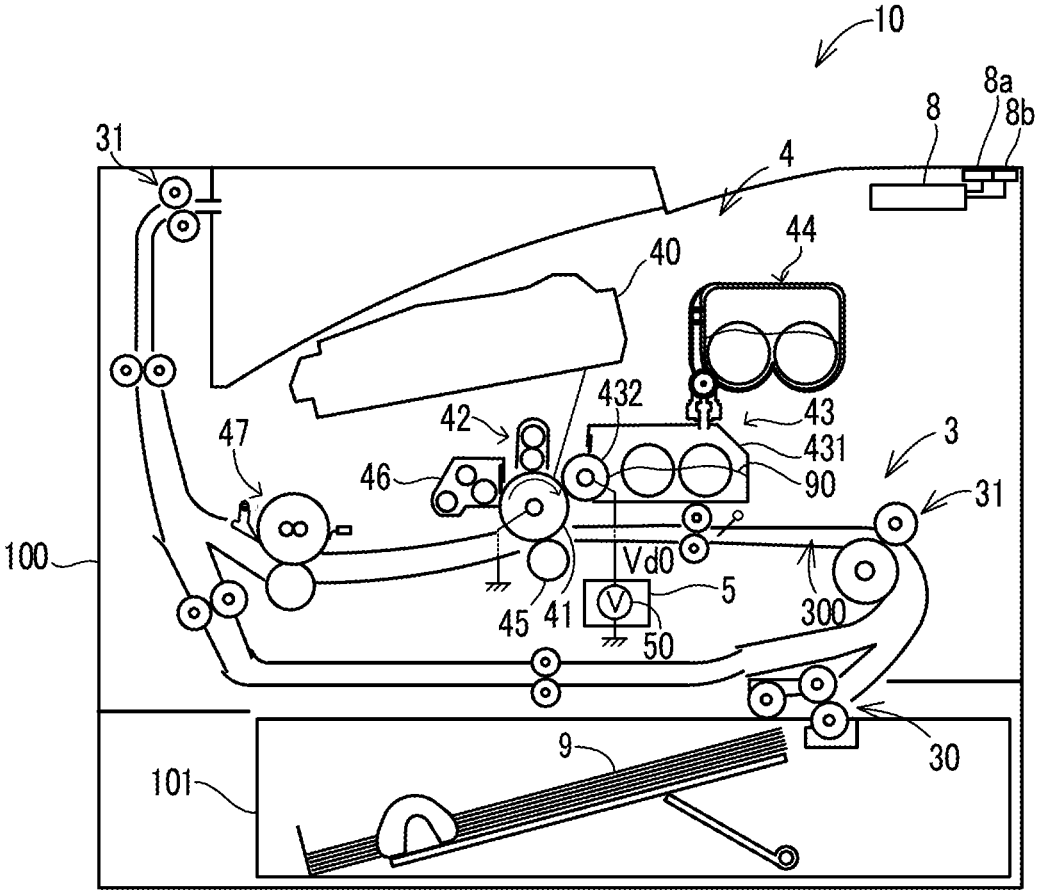
FIG. 1 is a configuration diagram of an image forming apparatus according to a first embodiment.

As shown in FIG. 1, the image forming apparatus 10 includes, within a body 100, a sheet conveying mechanism 3, the print processing device 4, and a control unit 8. Furthermore, the image forming apparatus 10 also includes an operation device 8*a* and a display device 8*b*.

In the sheet conveying mechanism 3, a sheet delivering mechanism 30 delivers the sheet 9 stored in a sheet storing portion 101 to a sheet conveyance path 300, and a plurality of conveyance roller pairs 31 conveys the sheet 9 along the sheet conveyance path 300.

The print processing device 4 includes an optical scanning unit 40, a photoconductor 41, a charging device 42, a developing device 43, a toner replenishing unit 44, a transfer device 45, a cleaning device 46, and a fixing device 47.

The drum-shaped photoconductor 41 rotates, and the charging device 42 charges a surface of the photoconductor 41. The optical scanning unit 40 writes an electrostatic latent image on the surface of the photoconductor 41 by scanning a light beam on the charged surface of the photoconductor 41. With this configuration, the electrostatic latent image is formed on the surface of the photoconductor 41.

The developing device 43 includes a developing container 431, a developing roller 432, and a developing bias unit 5, and is configured to execute a developing process. The developing process develops the electrostatic latent image on the photoconductor 41 using the toner 90 on the developing roller 432 to form a toner image on the surface of the photoconductor 41.

The developing container 431 stores the toner 90 supplied from the toner replenishing unit 44. The developing roller 432, disposed across a gap from the photoconductor 41, is a developing body that rotates inside the developing container 431 while carrying the toner 90.

The developing bias unit 5 includes a bias applying circuit 50 for applying, between the photoconductor 41 and the developing roller 432, a developing bias voltage Vd0 that is an AC voltage superimposed on a DC voltage. The developing bias voltage Vd0 is obtained by superimposing an AC voltage V1 on a DC voltage V2 (refer to FIG. 3).

The transfer device 45 transfers the toner image from the surface of the photoconductor 41 to the sheet 9 moving along the sheet conveyance path 300. The fixing device 47 fixes the toner image to the sheet 9 by heating the toner image transferred to the sheet 9.

The cleaning device 46 removes the toner 90 remaining on the surface of the photoconductor 41. The toner replenishing unit 44 replenishes unused toner 90 to the developing device 43.

The operation device 8*a* and the display device 8*b* are user interfaces. The operation device 8*a* receives user operations and may include operation buttons or a touch panel device. The display device 8*b* displays information and may include a display panel such as a liquid crystal panel.

[Control Unit 8]

Figure 2:
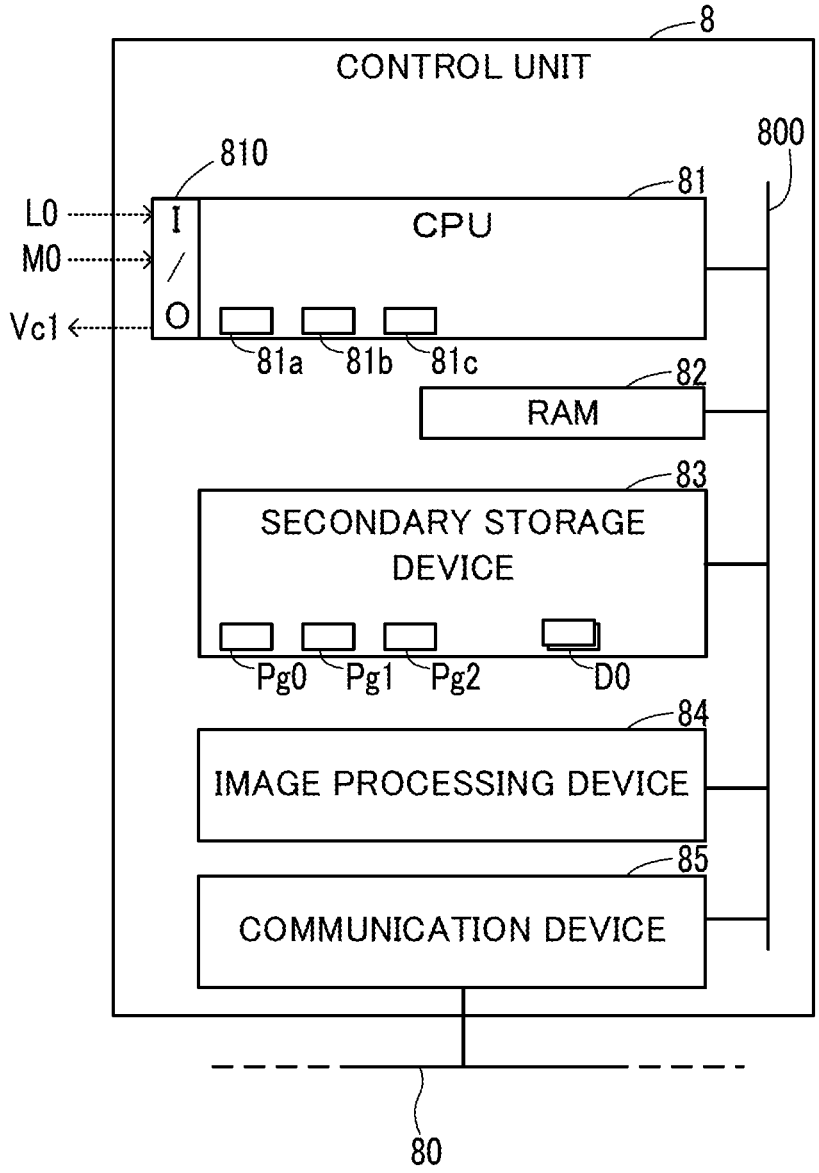
FIG. 2 is a configuration diagram of a control device in the image forming apparatus according to the first embodiment.

As shown in FIG. 2, the control unit 8 includes a CPU (Central Processing Unit) 81, a RAM (Random Access Memory) 82, a secondary storage device 83, an image processing device 84, and a communication device 85.

By executing a program stored in advance in the secondary storage device 83 or the like, the CPU 81 executes various operations, data processing, and control of electric devices included in the image forming apparatus 10. The CPU 81 is an example of a control device.

It is noted that another processor, such as a DSP (Digital Signal Processor), may execute control relating to the print processing instead of the CPU 81.

The RAM 82 is a main storage device for primarily storing the programs executed by the CPU 81, and data that is output and referred to by the CPU 81 during the process of executing the programs.

The secondary storage device 83 is a computer-readable, non-volatile storage device for storing data or programs referred to by the CPU 81. For example, the secondary storage device 83 may be a flash memory or a hard disk drive.

The image processing device 84 is a processor for executing multiple pieces of image processing, such as processing and data conversion of image data used in the print processing. The image processing device 84 may be realized with an MPU (Micro Processing Unit) or the DSP (Digital Signal Processor).

The communication device 85 is a communication interface device for communicating with an information processing device (not shown) via a network 80 that includes a LAN (Local Area Network) and the internet. The information processing device may be a personal computer or a smartphone. The CPU 81 sends and receives data to and from the information processing device all via the communication device 85.

The CPU 81 is able to transfer data between the RAM 82, the secondary storage device 83, the image processing device 84, and the communication device 85 via a bus 800. Furthermore, the CPU 81 receives various types of signals such as a leakage detection signal L0 and an AC measuring signal M0, both described below, via an I/O port 810. Furthermore, the CPU 81 outputs various types of control signals such as an AC bias control signal Vc1, both described below, to the electric devices via the I/O port 810.

For example, the CPU 81 functions as a print controlling device 81*a* by executing a print controlling program Pg0 stored in the secondary storage device 83. The print controlling device 81*a* receives print data from the information processing device via the communication device 85, and makes the print processing device 4 execute the print processing based on the received print data.

Furthermore, the CPU 81 functions as a bias adjusting device 81*b* by executing a bias adjusting program Pg1 stored in the secondary storage device 83. The bias adjusting device 81*b* executes a developing bias adjustment process for setting a developing bias AC level that is the level of the AC voltage V1 in the developing bias voltage Vd0 during the execution of the print processing by the developing device 43.

In the developing bias adjustment process, the bias adjusting device 81*b* generates aerial discharge between the developing roller 432 and the photoconductor 41 by gradually increasing the level of the AC voltage V1 in the developing bias voltage Vd0. Furthermore, the bias adjusting device 81*b* sets the developing bias AC level according to the level of the AC voltage V1 when the aerial discharge occurs. It is noted that the level of the AC voltage V1 corresponds to the amplitude of the AC voltage V1.

For example, the bias adjusting device 81*b* sets the developing bias AC level to a value calculated by subtracting a predetermined margin value from the level of the AC voltage V1 when the aerial discharge occurs.

In addition, the bias adjusting device 81*b* also may set the developing bias AC level to a value calculated by multiplying a predetermined coefficient that is less than one by the level of the AC voltage V1 when the aerial discharge occurs.

Before being shipped, the image forming apparatus 10 is installed in a standard environment in which conditions such as atmospheric pressure, temperature, and humidity are at predetermined standard states. In the standard environment, the bias adjusting device 81*b* executes the developing bias adjustment process. This allows for the level of the AC voltage V1 in the developing bias voltage Vd0 during execution of the developing process to be set at a standard level suitable for the standard environment.

Furthermore, in a state where the image forming apparatus 10 is installed in its place of use, a serviceperson or a user executes a predetermined adjustment start operation on the image forming apparatus 10. The bias adjusting device 81*b* executes the developing bias adjustment process in response to the adjustment start operation.

By executing the developing bias adjustment process in a state where the image forming apparatus 10 is installed in its place of use, the level of the AC voltage V1 in the developing bias voltage Vd0 during execution of the developing process is updated from the standard level to a level suitable for the usage environment.

Meanwhile, when the image forming apparatus 10 is installed in its place of use and an initial operation test is executed, an adverse effect on image quality caused by the aerial discharge may not be noticeable. In this case, there is a risk that the image forming apparatus 10 could be used without executing the developing bias adjustment process that should be executed in the environment in which the image forming apparatus 10 is installed.

When the image forming apparatus 10 is used in a state where the aerial discharge occurs, image quality and the photoconductor 41 could deteriorate.

On the other hand, the CPU 81 of the image forming apparatus 10 executes a leakage monitoring process described below. This prevents the image forming apparatus 10 from being used without executing the developing bias adjustment process that should be executed.

[Configuration of Developing Bias Unit 5]

Figure 3:
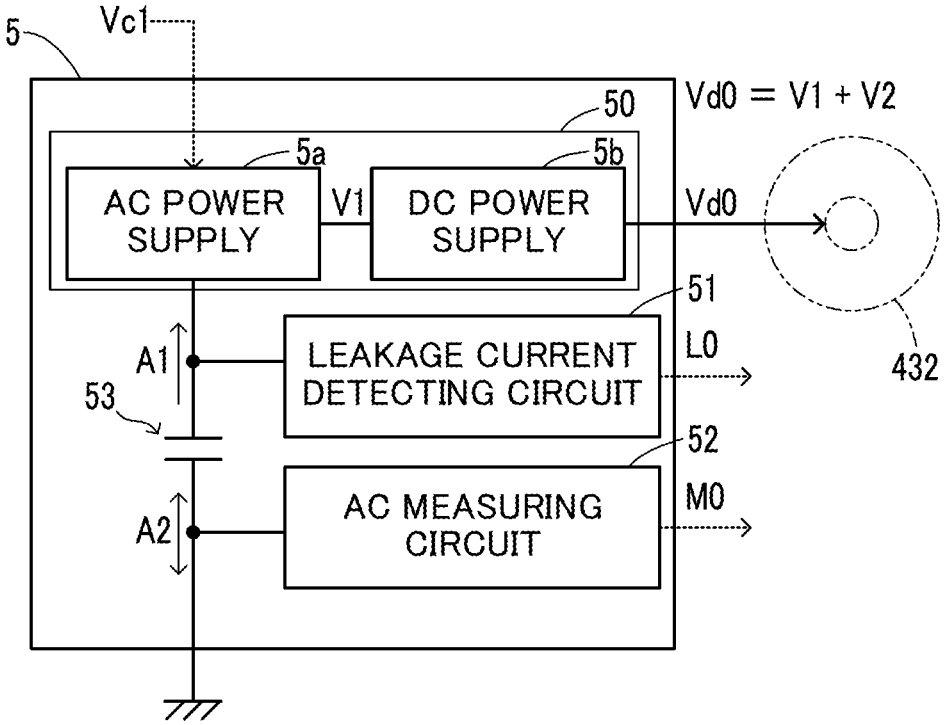
FIG. 3 is a configuration diagram of a developing bias unit in the image forming apparatus according to the first embodiment.

As shown in FIG. 3, the developing bias unit 5 includes the bias applying circuit 50, a leakage current detecting circuit 51, an AC measuring circuit 52, and a low-pass filter element 53.

The bias applying circuit 50 includes an AC power supply 5*a* and a DC power supply 5*b*. The bias applying circuit 50, the leakage current detecting circuit 51, the AC measuring circuit 52, and the low-pass filter element 53 may be provided on one printed board.

The AC power supply 5*a* is a circuit for generating and outputting the AC voltage V1 of a predetermined frequency with reference to a ground level. The AC voltage V1 changes in a continuous square waveform.

The AC bias control signal Vc1 output by the CPU 81 is input to the AC power supply 5*a*. The AC power supply 5*a* adjusts the level of the AC voltage V1, that is, the amplitude of the AC voltage V1, to the level indicated by the AC bias control signal Vc1. It is noted that the bias applying circuit 50 is one of the electric devices controlled by the CPU 81.

The DC power supply 5*b* generates a predetermined level of the DC voltage V2 and applies, to the developing roller 432, the developing bias voltage Vd0 in which the DC voltage V2 and the AC voltage V1 are superimposed.

On the other hand, the photoconductor 41 is grounded. Accordingly, the bias applying circuit 50 applies the developing bias voltage Vd0 in between the photoconductor 41 and the developing roller 432.

When aerial discharge occurs between the developing roller 432 and the photoconductor 41, a weak direct current that is a leakage current A1 flows from the developing roller 432 to the photoconductor 41 via the bias applying circuit 50. A period during which the leakage current A1 occurs is sufficiently shorter than a cycle of the AC voltage V1.

The leakage current detecting circuit 51 detects the leakage current A1 that flows sporadically through the bias applying circuit 50 when aerial discharge occurs. A direct current that is not synchronized with a cycle of the AC voltage V1 and flows sporadically at a level higher than a predetermined level is detected by the leakage current detecting circuit 51 as the leakage current A1.

The leakage current detecting circuit 51 outputs the leakage detection signal L0 to the CPU 81 when the leakage current A1 is detected.

On the other hand, even in a situation where aerial discharge is not occurring between the developing roller 432 and the photoconductor 41, an alternating current A2 flows through the bias applying circuit 50 in synchronization with a cycle of the AC voltage V1 of the developing bias voltage Vd0.

Specifically, the alternating current A2 is generated when the developing bias voltage Vd0 rises and falls while changing in a continuous square waveform, and the alternating current A2 is inverted in polarity in response to a direction in which the developing bias voltage Vd0 changes.

For example, while the leakage current A1 is of an order of microamperes, the alternating current A2 is of an order of milliamperes.

It has been found through experiments that an alternating current A2 flowing in an environment in which aerial discharge tends to occur, such as an environment with low atmospheric pressure, is larger in magnitude than an alternating current A2 flowing in the standard environment.

That is, it can be said that aerial discharge tends to occur when the magnitude of the alternating current A2, flowing through the bias applying circuit 50 in the environment in which the image forming apparatus 10 is used, exceeds a predetermined range that is set based on the alternating current A2 flowing through the bias applying circuit 50 in the standard environment. In this way, the magnitude of the alternating current A2 flowing through the bias applying circuit 50 becomes an indicator for how easily aerial discharge occurs.

The AC measuring circuit 52 measures the magnitude of the alternating current A2 flowing through the bias applying circuit 50 in synchronization with a cycle of the AC voltage V1 in the developing bias voltage Vd0. The AC measuring circuit 52 outputs the AC measuring signal M0 indicating a measurement to the CPU 81.

In the example shown in FIG. 3, the AC measuring circuit 52 detects a magnitude of a current after a leakage current A1 component is removed by the low-pass filter element 53. For example, the AC measuring circuit 52 rectifies a current flowing through the bias applying circuit 50 and measures the magnitude of the rectified current.

For example, the low-pass filter element 53 may be a capacitor for removing the leakage current A1 component from the current flowing through the bias applying circuit 50 while leaving a frequency component of the AC voltage V1.

[Leakage Monitoring Process]

In the following, an example procedure of the leakage monitoring process is described with reference to the flowchart shown in FIG. 4.

The CPU 81 functions as a leakage monitoring device 81*c* for executing the leakage monitoring process by executing a leakage monitoring program Pg2 stored in the secondary storage device 83.

The leakage monitoring device 81*c* executes the leakage monitoring process when the developing device 43 is executing the developing process under the control of the print controlling device 81*a*. In the following description, S101, S102, . . . are identification signs representing the various steps in the leakage monitoring process in the present embodiment.

<Step S101>

First, the leakage monitoring device 81*c* determines whether or not a measurement indicated by the AC measuring signal M0 during the execution of the developing process, satisfies a bias adjusting condition that includes a condition that the AC measuring signal M0 exceeds a predetermined allowable value.

For example, the bias adjusting condition may be that a situation where the measurement indicated by the AC measuring signal M0 exceeds the allowable value, occurs at a predetermined frequency within a predetermined period of time.

When the leakage monitoring device 81*c* determines that the measurement satisfies the bias adjusting condition, the leakage monitoring device 81*c* moves the process to step S103, and otherwise, moves the process to step S102.

<Step S102>

The leakage monitoring device 81*c* repeats step S101 until the measurement satisfies the bias adjusting condition or until the developing process ends. When the leakage monitoring device 81*c* determines that the developing process has ended without the measurement satisfying the bias adjusting condition, the leakage monitoring device 81*c* ends the leakage monitoring process.

<Step S103>

On the other hand, when the leakage monitoring device 81*c* determines that the measurement satisfies the bias adjusting condition, the leakage monitoring device 81*c* executes a predetermined warning process and moves the process to step S104.

The warning process outputs a warning to prompt execution of the developing bias adjustment process. For example, the warning process may display a warning message on the display device 8*b* to prompt execution of the developing bias adjustment process.

In addition, the warning process also may send a warning message to a predetermined address via the communication device 85 to prompt execution of the developing bias adjustment process.

<Step S104>

In step S104, the leakage monitoring device 81*c* waits until the adjustment start operation is executed on the operation device 8*a*.

<Step S105>

When the leakage monitoring device 81*c* detects the adjustment start operation on the operation device 8*a*, the bias adjusting device 81*b* executes the developing bias adjustment process. With this configuration, the level of the AC voltage V1 in the developing bias voltage Vd0 during execution of the developing process is updated from the standard level to the level suitable for the usage environment. Thereafter, the leakage monitoring device 81*c* ends the leakage monitoring process.

By employing the image forming apparatus 10, the warning process is executed when the measurement by the AC measuring circuit 52 satisfies the bias adjusting condition, that is, when the developing bias adjustment process should be executed (S105). Accordingly, this configuration prevents the image forming apparatus 10 from being used without executing the developing bias adjustment process that should be executed.

In addition, before the image forming apparatus 10 is shipped, the bias adjusting device 81*b* may automatically set the allowable value when the developing bias adjustment process is executed in the standard environment.

For example, when executing the developing bias adjustment process, the bias adjusting device 81*b* automatically sets the allowable value based on the measurement by the AC measuring circuit 52 when the leakage current A1 is detected by the leakage current detecting circuit 51.

More specifically, the bias adjusting device 81*b* may set the allowable value to a value calculated by subtracting a predetermined margin value from the measurement by the AC measuring circuit 52 when the leakage current A1 is detected by the leakage current detecting circuit 51.

In addition, the bias adjusting device 81*b* may also set the allowable value to a value calculated by multiplying a predetermined coefficient that is less than one by the measurement by the AC measuring circuit 52 when the leakage current A1 is detected by the leakage current detecting circuit 51.

In the image forming apparatus 10, the print controlling device 81*a* sets the AC bias control signal Vc1 indicating a control value that corresponds to the standard level of the AC voltage V1 or the developing bias AC level. Furthermore, the AC power supply 5*a* of the bias applying circuit 50 adjusts the level of the AC voltage V1 according to the AC bias control signal Vc1 input from the print controlling device 81*a*.

Meanwhile, electrical characteristics of devices, including the developing roller 432 and the photoconductor 41, relating to the developing bias voltage Vd0 change in response to inconsistency in distance between the developing roller 432 and the photoconductor 41, and in response to environmental conditions such as temperature and humidity at the site where the image forming apparatus 10 is installed.

On the other hand, due to requests for cost reduction, an open-loop control type of the bias applying circuit 50 is employed in the image forming apparatus 10. The AC power supply 5*a* in this bias applying circuit 50 adjusts the level of the AC voltage V1 by open-loop control according to the AC bias control signal Vc1 input from the print controlling device 81*a*. That is, feedback control of the AC voltage V1 is not executed.

In a case where the open-loop control type of the bias applying circuit 50 is employed, when the electrical characteristics of the devices relating to the developing bias voltage Vd0 change, the level of the AC voltage V1 actually applied to the developing roller 432 changes even if the AC bias control signal Vc1 is unchanged. When the AC voltage V1 is excessive or deficient, image quality deteriorates.

According to an experiment, it was found that the alternating current A2 flowing through the bias applying circuit 50 becomes an indicator of the electrical characteristics of devices relating to the developing bias voltage Vd0.

Figure 6:
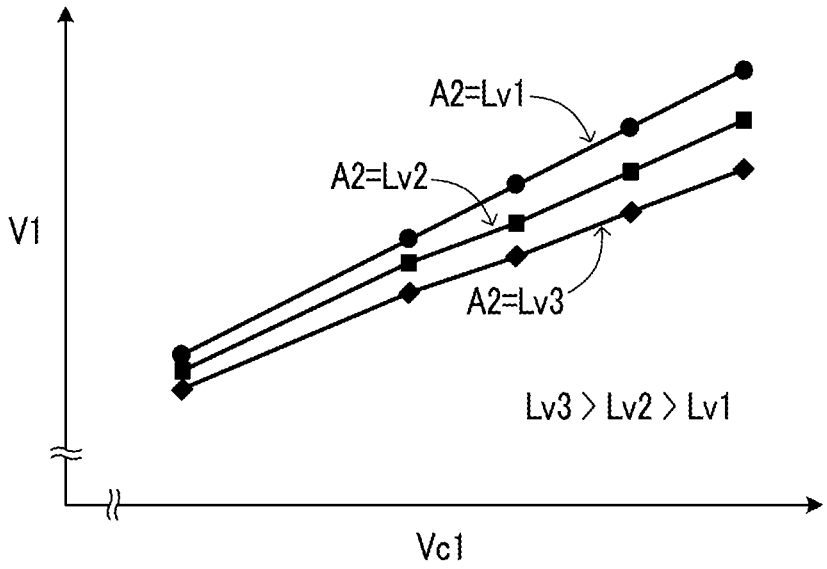
FIG. 6 is a graph showing an example of a corresponding relationship in a bias applying circuit between a value of an AC bias controlling signal and an AC voltage that is actually applied to a developing roller.

FIG. 6 shows an example of a corresponding relationship between the value of the AC bias control signal Vc1 and the AC voltage V1 actually applied to the developing roller 432 when the magnitude of the alternating current A2 flowing through the bias applying circuit 50 is classified into a first current level Lv1, a second current level Lv2, and a third current level Lv3.

As shown in FIG. 6, the corresponding relationship between the AC bias control signal Vc1 and the AC voltage V1 is uniquely determined for each magnitude of the alternating current A2.

Accordingly, in the present embodiment, the print controlling device 81*a*, in response to the measurement results of the AC measuring circuit 52, sets the value of the AC bias control signal Vc1 corresponding to the developing bias AC level.

Specifically, multiple pieces of correspondence information D0 are preliminarily set. In the present embodiment, the multiple pieces of the correspondence information D0 are preliminarily stored in the secondary storage device 83.

Each of the multiple pieces of the correspondence information D0 indicates a corresponding relationship between the level of the AC voltage V1 and the value of the AC bias control signal Vc1, and corresponds to a different magnitude of the alternating current A2.

For example, two pieces of the correspondence information D0 may be stored in the secondary storage device 83, the two pieces of the correspondence information D0 respectively corresponding to two cases where the magnitude of the alternating current A2 is the first current level Lv1 and the third current level Lv3 as shown in FIG. 6. In addition, three or more pieces of the correspondence information D0 may also be stored in the secondary storage device 83, the three or more pieces of the correspondence information D0 each corresponding to a different magnitude of the alternating current A2.

Each piece of the correspondence information D0 may be a look-up table indicating the corresponding relationship between the level of the AC voltage V1 and the value of the AC bias control signal Vc1. In addition, each piece of the correspondence information D0 may also be a formula that derives the value of the AC bias control signal Vc1 from the developing bias AC level.

The print controlling device 81*a* derives the value of the AC bias control signal Vc1, a control value corresponding to the developing bias AC level, according to the multiple pieces of the correspondence information D0 and the measurement results of the AC measuring circuit 52. Furthermore, the print controlling device 81*a* outputs the AC bias control signal Vc1 indicating the derived control value to the AC power supply 5*a* of the bias applying circuit 50.

For example, the print controlling device 81*a* may use the following two types of deriving processes to derive the value of the AC bias control signal Vc1.

A first deriving process includes a process that selects, from the multiple pieces of the correspondence information D0, one piece of the correspondence information D0 corresponding to the measurement result of the AC measuring circuit 52, and a process that, based on the selected piece of the correspondence information D0, derives the value of the AC bias control signal Vc1 corresponding to the developing bias AC level.

For example, in the first deriving process, the print controlling device 81*a* may select one piece of the correspondence information D0 from three or more pieces of the correspondence information D0, the one piece of the correspondence information D0 corresponding to the magnitude of the alternating current A2 most similar to the measurement result of the AC measuring circuit 52.

By employing the first deriving process, it is possible to derive the value of the AC bias control signal Vc1 with a simple calculation.

A second deriving process derives the value of the AC bias control signal Vc1 corresponding to the developing bias AC level by using an interpolation calculation based on the multiple pieces of the correspondence information D0 and the measurement result of the AC measuring circuit 52. For example, the interpolation calculation may be a linear interpolation calculation.

By employing the second deriving process, it is possible to derive the value of the AC bias control signal Vc1 with high precision just by preliminarily setting two pieces of the correspondence information D0 corresponding to minimum and maximum values within an estimated variation range of the alternating current A2.

It is noted that there is a risk that image quality could become unstable when the value of the AC bias control signal Vc1 changes frequently in response to change in the measurement result of the AC measuring circuit 52.

Accordingly, the print controlling device 81*a* may execute a process to set the value of the AC bias control signal Vc1 in response to the measurement result of the AC measuring circuit 52 just once each time a predetermined execution condition is satisfied.

For example, the execution condition may include that the image forming apparatus 10 has been activated, and/or that the developing process corresponding to a series of print jobs has been executed.

In addition, the print controlling device 81*a* may also calculate an average of the measurement results of the AC measuring circuit 52 when the developing process is executed multiple times, and in response to the average, set the value of the AC bias control signal Vc1.

As shown above, in the present embodiment, the open-loop control type of the bias applying circuit 50 is employed, and the value of the AC bias control signal Vc1 is set in response to the measurement result of the AC measuring circuit 52. This prevents the level of the AC voltage V1 applied to the developing roller 432 from changing due to the change in the electrical characteristics of devices relating to the developing bias voltage Vd0.

Second Embodiment

Next, an example procedure of the leakage monitoring process relating to a second embodiment is described with reference to the flowchart shown in FIG. 5.

In the following, differences between the second embodiment and the first embodiment are described. In the following description, S201, S202, . . . are identification signs representing the multiple steps in the leakage monitoring process in the present embodiment.

Figure 4:
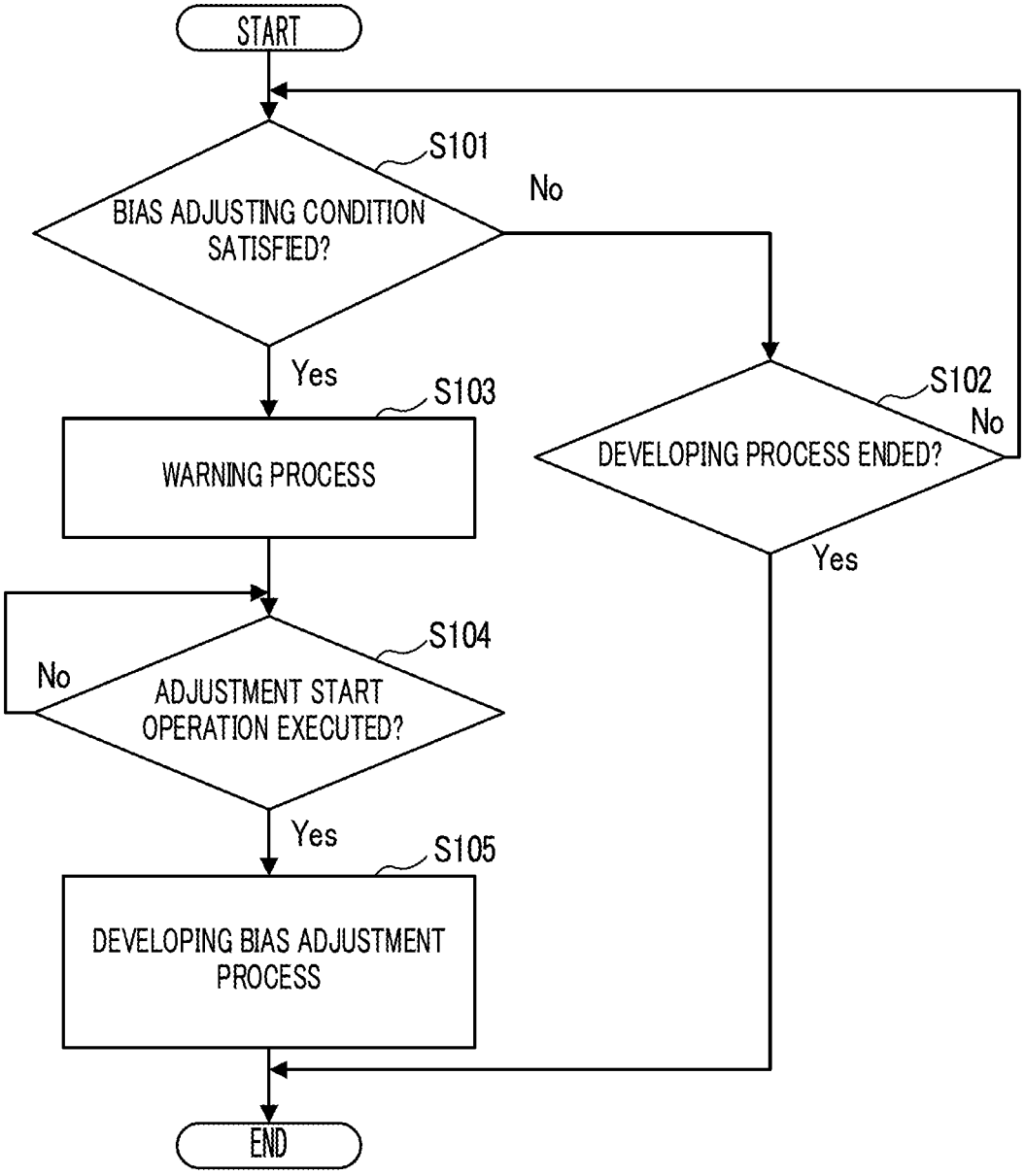
FIG. 4 is a flowchart showing an example of a procedure for a leakage monitoring process in the image forming apparatus according to the first embodiment.
Figure 5:
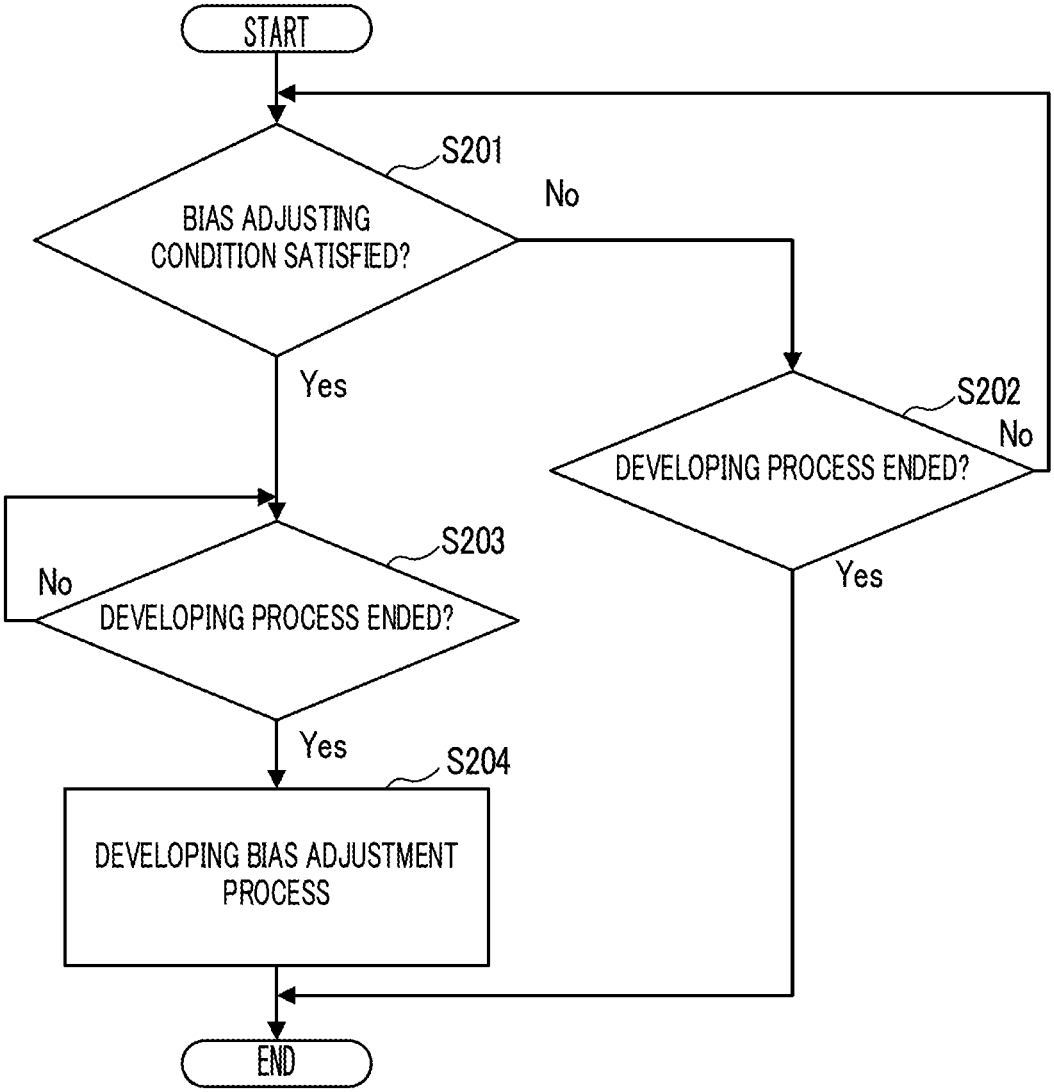
FIG. 5 is a flowchart showing an example of a procedure for a leakage monitoring process in an image forming apparatus according to a second embodiment.

The leakage monitoring process shown in FIG. 5 has replaced steps S103 and S104 in the leakage monitoring process shown in FIG. 4 with step S203. Steps S201, S202, and S204 in FIG. 5 are respectively the same as steps S101, S102, and S105 in FIG. 4.

In step S102, the leakage monitoring device 81*c* moves the process to step S203 when the leakage monitoring device 81*c* determines that the measurement satisfies the bias adjusting condition.

In step S203, the leakage monitoring device 81*c* waits until the developing process ends. When the developing process ends, the bias adjusting device 81*b* executes the developing bias adjustment process (S204). With this configuration, the level of the AC voltage V1 in the developing bias voltage Vd0 during execution of the developing process is updated from the standard level to the level suitable for the usage environment.

In the present embodiment, when the measurement satisfies the bias adjusting condition, the bias adjusting device 81*b* automatically executes the developing bias adjustment process without waiting for an operation from a user (S204). Thereafter, the leakage monitoring device 81*c* ends the leakage monitoring process. By employing the present embodiment, an effect similar to that of the first embodiment is achieved.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a photoconductor on whose surface an electrostatic latent image is formed;

a developing device configured to execute a developing process that develops the electrostatic latent image on the photoconductor using toner on a developing body, the developing device including the developing body and a bias applying circuit, wherein the developing body, disposed across a gap from the photoconductor, rotates while carrying toner, and the bias applying circuit applies, between the photoconductor and the developing body, a developing bias voltage in which an AC voltage and a DC voltage are superimposed;

a leakage current detecting circuit configured to detect a direct current that flows through the bias applying circuit when aerial discharge occurs between the developing body and the photoconductor;

an AC measuring circuit configured to measure a magnitude of an alternating current that flows through the bias applying circuit in synchronization with a cycle of the AC voltage in the developing bias voltage; and a control device configured to execute a developing bias adjustment process for controlling the bias applying circuit to change a level of the AC voltage in the developing bias voltage, then, based on the level of the AC voltage when the leakage current detecting circuit detects the direct current, setting a developing bias AC level that is a level of the AC voltage in the developing bias voltage during execution of the developing process, wherein the control device, when a measurement by the AC measuring circuit during the execution of the developing process exceeds a predetermined allowable value, executes a warning process to prompt execution of the developing bias adjustment process, or the control device executes the developing bias adjustment process to update the level of the AC voltage in the developing bias voltage during execution of the developing process, multiple pieces of correspondence information are preliminarily set, each piece indicating a corresponding relationship between the level of the AC voltage and a control value, and each piece corresponding to a different magnitude of the AC voltage, and the control device, based on the multiple pieces of the correspondence information and the measurement result of the AC measuring circuit, derives the control value corresponding to the developing bias AC level and outputs the derived control value to the bias applying circuit.

2. The image forming apparatus according to claim 1, wherein the control device is configured to automatically set the allowable value based on the measurement that was obtained by the AC measuring circuit when the direct current was detected by the leakage current detecting circuit during execution of the developing bias adjustment process in a predetermined standard environment.

3. The image forming apparatus according to claim 1, wherein the control device selects, from the multiple pieces of the correspondence information, one piece of the correspondence information corresponding to the measurement result of the AC measuring circuit, and based on the selected piece of the correspondence information, the control device derives the control value corresponding to the level of the developing bias AC level.

4. The image forming apparatus according to claim 1, wherein the control device derives the control value corresponding to the developing bias AC level by using an interpolation calculation based on the multiple pieces of the correspondence information and the measurement result of the AC measuring circuit.

* * * * *